United States Patent [19]

Kape

[11] Patent Number: 4,896,379

[45] Date of Patent: Jan. 30, 1990

[54] DROP DOWN CUFF ARRANGEMENT FOR PANT LEGS OR SLEEVES

[76] Inventor: Sandra Kape, 86 Alta Vista, Kirkland, Quebec, Canada

[21] Appl. No.: 240,208

[22] Filed: Sep. 6, 1988

[51] Int. Cl.[4] ..... A41D 27/24

[52] U.S. Cl. ..... 2/269; 2/227; 2/243 B

[58] Field of Search ..... 2/269, 79, 227, 243 R

[56] References Cited

U.S. PATENT DOCUMENTS

| | | | |
|---|---|---|---|
| 119,431 | 7/1909 | Messick . | |
| 811,662 | 2/1906 | Puryear | 2/269 |
| 2,214,120 | 9/1940 | Connor | 2/269 |
| 2,677,829 | 5/1954 | Rothstein et al. | 2/269 |
| 3,060,446 | 10/1962 | Horne | 2/269 |
| 3,166,765 | 1/1965 | Getchell | 2/269 |
| 3,328,809 | 7/1967 | Payne et al. | 2/269 |
| 3,435,463 | 4/1969 | Jay | 2/269 |
| 3,722,001 | 3/1973 | Bailey | 2/269 |
| 4,149,275 | 4/1979 | Sanchez | 2/269 |
| 4,631,753 | 12/1986 | Ehring | 2/269 X |
| 4,697,288 | 10/1987 | Palumbo | 2/269 |

FOREIGN PATENT DOCUMENTS

| | | | |
|---|---|---|---|
| 643886 | 7/1962 | Canada | 2/269 |
| 471550 | 6/1969 | Switzerland | 2/79 |

*Primary Examiner*—Werner H. Schroeder
*Assistant Examiner*—Jeanette E. Chapman
*Attorney, Agent, or Firm*—Fetherstonhaugh & Co.

[57] ABSTRACT

A drop down cuff arrangement for pant legs or sleeves provides for lowering of a child's pant legs or sleeves and a cuff to cover the old seam so that it is no longer visible. The drop down cuff arrangement comprises a pant leg or sleeve having a high position wherein a first portion of the leg or sleeve includes a finished hem at the end to form a high position hemline, cuff strip stitched to the outside of the leg or sleeve above the high position hemline, folded upwards away from the high position hemline, held in place to the outside of the leg or sleeve by a removable attachment system, and the pant leg or sleeve having a low position wherein the cuff strip is released from the removable attachment system and folded down over the high position hemline.

2 Claims, 2 Drawing Sheets

DROP DOWN CUFF ARRANGEMENT FOR PANT LEGS OR SLEEVES

The present invention relates to a cuff on a pant leg or sleeve of a jacket. More specifically, the present invention provides a drop down cuff for pant legs or sleeves.

During a child's growth, the legs and arms tend to grow at a faster rate than the child's girth. Thus whereas trousers or jackets may fit a child's waist or chest, the pant legs or arm sleeves are the first part of a garment that appear too small. In some cases cuffs on pant legs can be lowered, and sleeves lengthened, however, in the majority of cases, clothes are not made to be lengthened as there is insufficient material available to lower a hem either on pant legs or on jacket sleeves.

Various attempts have been made to provide garments with legs or sleeves having adjustable lengths. One example is Canadian Patent 643,886 which issued July 3rd, 1962. However, in most cases the garments require a lot of material to be either rolled up or formed into a bulky cuff at the bottom of the leg or sleeve which is inconvenient. Furthermore, when the cuff is lowered, there is always a worn hemline visible. Such a hemline can become frayed and thus the pant legs show this frayed hemline when lowered.

I have found that by making a drop down cuff arrangement according to my invention, I can provide a cuff that folds down over a hemline of the pant leg or sleeve, thus hiding the hemline so that it cannot be seen as a worn or frayed hemline. Thus legs of a pair of pants or sleeves of a jacket can have the hemlines lowered without the original hemline being visible.

The present invention provides a drop down cuff arrangement for a pant leg, sleeve or the like comprising: a pant leg or sleeve having a high position wherein a first portion of the leg or sleeve includes a finished hem at the end to form a high position hemline; cuff strip stitched to the outside the leg or sleeve above the high position hemline, folded upwards away from the high position hemline, held in place to the outside of the leg or sleeve by a removable attachment means, and the pant leg or sleeve having a low position wherein the cuff strip is released from the removable attachment means and folded down over the high position hemline. In a preferred embodiment, the removable attachment means are Velcro pads.

In drawings which illustrate embodiments of the invention:

Figure 3:
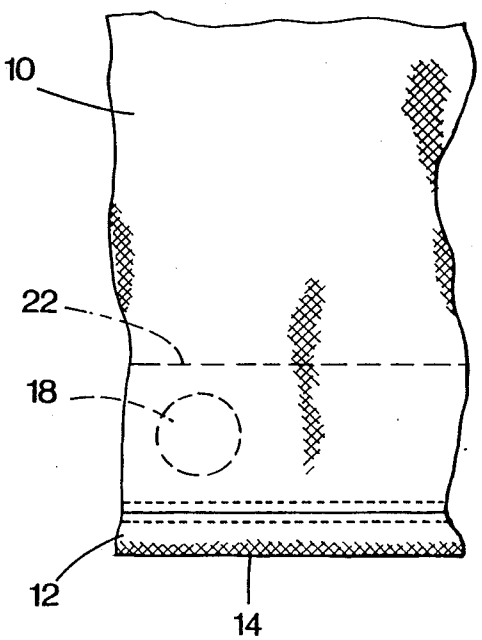
FIG. 3 is an inside view of the pant leg shown in FIG. 1.
Figure 2:
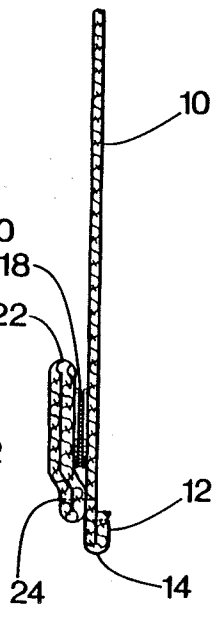
FIG. 2 is a cross section taken through one side of a pant leg shown in FIG. 1.
Figure 1:
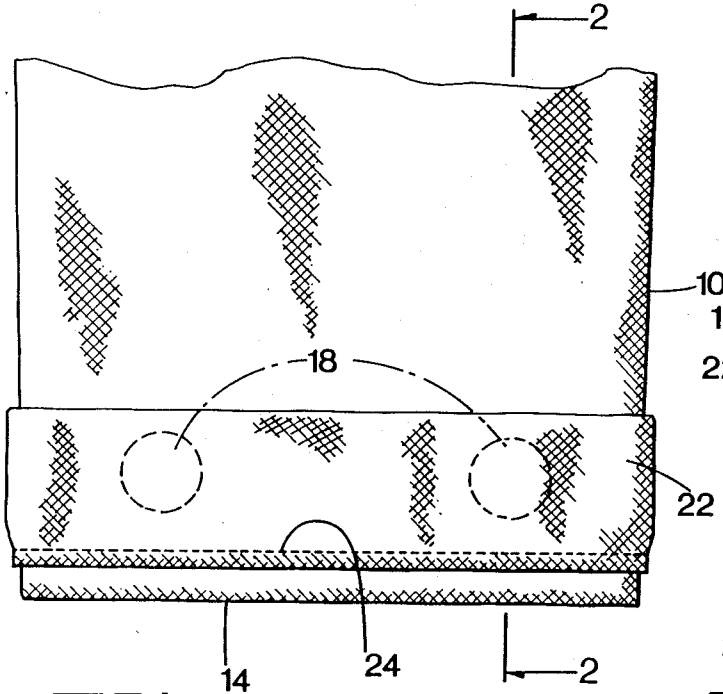
FIG. 1 is an outside view of a pant leg with a drop down cuff arrangement according to one embodiment of the present invention in the high position.

Referring now to the drawings, the pant leg 10 or sleeve is provided with a high position hemline as shown in FIGS. 1, 2 and 3. The pant leg 10 has a turned in hem 12 to provide a high position hemline 14.

A cuff 22, which is a tubular construction, is attached to the outside of the leg 10 by a cuff stitch 24 at the base of the cuff 22. Two opposed pairs of Velcro pads 18, as shown in FIGS. 1 and 2, are attached to the outside surface of the leg 10 above the high position hemline 14 and on the inside surface of the cuff 22. In the high position as shown in FIGS. 1, 2 and 3, the cuff 22 is held to the pant leg by the two opposed pairs of Velcro pads 18 which are hidden under the cuff 22 when it is in the high position.

Figure 6:
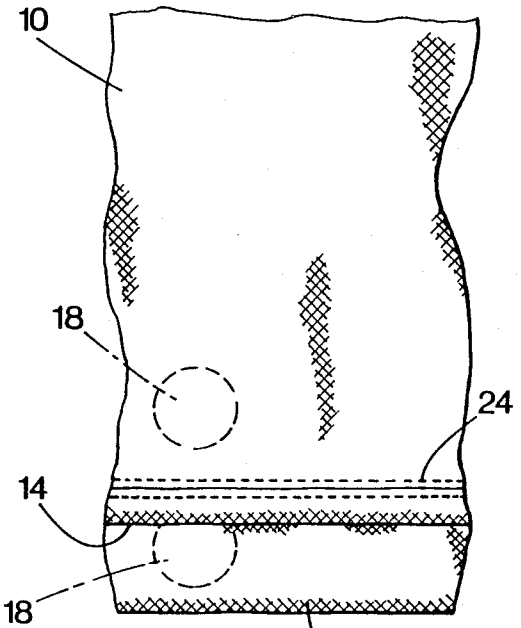
FIG. 6 is an inside view of the pant leg shown in FIG. 4.
Figure 5:
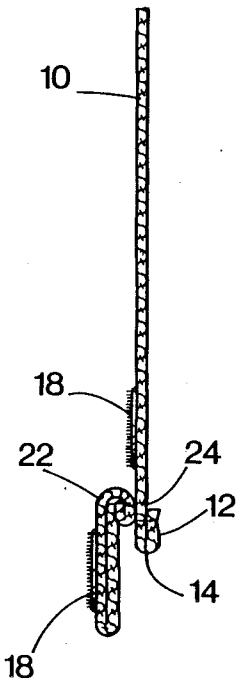
FIG. 5 is a cross section taken through one side of a pant leg shown in FIG. 4.
Figure 4:
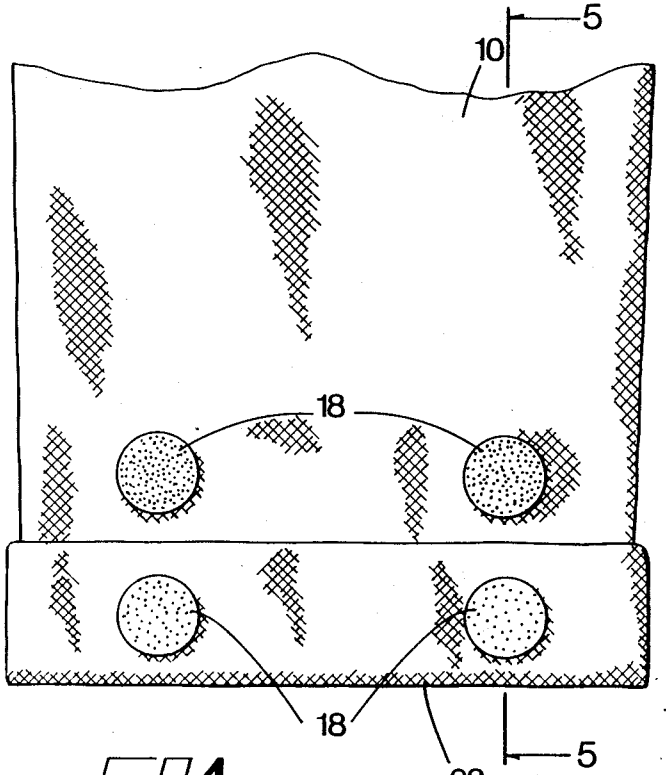
FIG. 4 is an outside view of the cuff arrangement shown in FIG. 1 in the low position.

When it is desired to lower the pant leg 10 from the high position to the low position, the cuff strip is released by separating the two opposed pairs of Velcro pads 18 and by folding the cuff down to the low position as shown in FIGS. 4, 5 and 6. The cuff strip 22 in the low position then hides the high position hemline 14. In the low position, the two separated pairs of Velcro pads 18 are visible both above the cuff strip 22 and on the lowered cuff strip itself, but apart from these two exposed pairs of pads there will be no indication that the pant legs or sleeves have been lowered.

Whereas Velcro pads hve been illustrated herein it will be apparent to those skilled in the art that other attachment means may be provided other than Velcro pads such as buttons, hooks and eyes, etc. The Velcro pads are shown as a circle, however, they could be strips. Whereas a pant leg is illustrated, the drop down cuff would apply equally well to a sleeve of a jacket or the like.

Various changes may be made to the embodiments described herein without departing from the scope of the present invention which is limited only by the following claims.

The embodiments of the invention in which an exclusive property or privilege is claimed are defined as follows.

1. A drop down cuff arrangement for a pant leg sleeve or the like comprising:

a pant leg or sleeve having a high position wherein a first portion of the leg or sleeve includes a finished hem at the end to form a high position hemline;

cuff strip stitched to the outside of the leg or sleeve above the high position hemline folded upwards away from the high position hemline, held in place to the outside of the leg or sleeve by a removable attachment means, and the pant leg or sleeve having a low position wherein the cuff strip is released from the removable attachment means and folded down over the high position hemline.

2. The drop down cuff arrangement according to claim 1 wherein the removable attachment means comprise VELCRO type pads attached to the leg or sleeve.

* * * * *